United States Patent [19]

Bakermans

[11] Patent Number: 5,070,719

[45] Date of Patent: Dec. 10, 1991

[54] TOOLING CONTROL MECHANISMS FOR STAMPING AND FORMING DIE ASSEMBLIES

[75] Inventor: Johannes C. W. Bakermans, Harrisburg, Pa.

[73] Assignee: AMP Incorporated, Harrisburg, Pa.

[21] Appl. No.: 598,289

[22] Filed: Oct. 16, 1990

[51] Int. Cl.[5] ..... B21J 9/18

[52] U.S. Cl. ..... 72/451; 72/407; 72/465; 100/281; 100/286

[58] Field of Search ..... 72/407, 408, 433, 450, 72/451, 465; 100/281, 286, 272

[56] References Cited

U.S. PATENT DOCUMENTS

| | | | |
|---|---|---|---|
| 3,044,393 | 7/1962 | Kury | 72/451 |
| 3,661,008 | 5/1972 | Richardson | 72/451 |
| 4,497,196 | 2/1985 | Bakermans et al. | 72/405 |
| 4,819,476 | 4/1989 | Bakermans et al. | 72/456 |
| 4,920,782 | 5/1990 | Hellwig | 72/451 |
| 4,934,173 | 6/1990 | Bakermans et al. | 72/407 |
| 4,967,586 | 11/1990 | Hecht | 72/451 |

*Primary Examiner*—David Jones

[57] ABSTRACT

Forming die assembly 18, 20 for carrying out a U-ing operation on a flat blank 58*a* has a forming tool 80 in one 18 of two ram assemblies 18, 20 which cooperates with a second forming tool 82 to perform the U-ing operation. During movement of the ram assemblies 18, 20 towards each other, the forming tool 80 is retracted and remains stationary during a final portion of the stroke of the ram assembly 18 in which it is carried. The forming tool is maintained in an extended position by a toggle mechanism during an initial portion of the stroke and the toggle is broken during a final portion of the stroke thereby to permit the forming tool to retract relative to the tooling assembly. On the return stroke, the forming tool is restored or shifted to its extended position by a biasing spring.

19 Claims, 10 Drawing Sheets

TOOLING CONTROL MECHANISMS FOR STAMPING AND FORMING DIE ASSEMBLIES

FIELD OF THE INVENTION

This invention relates to mechanisms for controlling the movement of individual tools in a stamping and forming die assembly.

BACKGROUND OF THE INVENTION

Stamping and forming die assemblies of the type used in punch presses for carrying out operations on strip material frequently contain tool members which must move relative to the reciprocable ram in which they are carried while the ram is moving from its open position to its closed position, in other words, while the forming operations are being carried out on the strip material. For example, it is common practice to design a die assembly having a forming tool which is in an extended position during initial movement of the ram from its open towards its closed position so that the tool can perform a forming operation on the strip material. At an intermediate stage of the stroke of the ram, it is then necessary that the forming tool remain stationary while the ram continues its movement to its closed position. It is common practice to provide heavy duty springs on the forming tool which are overcome by the ram when the forming tool stops moving so that the spring is compressed during the final portion of the stroke of the ram. When the ram returns to its open position, the compressed spring returns the forming tool to its extended position.

While the use of compression springs to achieve the overtravel of the ram relative to the forming tool has been used with satisfactory results in many die assemblies, the use of springs does have certain disadvantages. For example, the springs must be capable of withstanding a very large number of cycles and must be, in many cases, extremely stiff. The springs, therefore, must be relatively large relative to the size of the tool itself. The springs undergo fatigue in time and fail so that they must be replaced. Also, the use of springs necessitates the use of a relatively high capacity press for the reason that the energy required to compress the springs is in addition to the energy required to carry out the stamping and forming operations which are performed on the strip material.

The present invention is directed to the achievement of mechanisms for controlling the movement of tooling in a die assembly which avoids the use of heavy duty springs. The invention is particularly directed to the achievement of a toggle mechanism by means of which the relative movement of the tooling member with respect to the press ram is positively controlled.

The embodiment of the invention described below is particularly intended for use in a stamping and forming machine having first and second ram assemblies which are movable relatively towards and away from each other during each operating cycle of the machine. Stamping and forming machines of this type are fully described in U.S. Pat. Nos. 4,497,196 and 4,819,476 which are hereby incorporated by reference into this description.

THE INVENTION

The invention comprises a stamping and forming machine having first and second machine parts which are movable relatively towards and away from each other between open and closed positions during each operating cycle of the machine. The first and second machine parts have opposed first and second leading end portions which are adjacent to each other when the parts are in their closed positions and which are spaced apart when the parts are in their open positions. The first part has a machine element therein which extends normally of the first leading end portion and which contacts a work piece, which is between the leading end portions during movement of the parts from their open positions to their closed positions. The element is in an extended position during one portion of the operating cycle and is in a retracted position during another portion of the operating cycle. Element moving means for moving the element between its extended and retracted positions are provided on the machine. The machine is characterized in that the element moving means comprises toggle means in the first machine part. The toggle means comprises first and second toggle links which are pivotally connected at a knee joint, the first link being pivoted to the first machine part and the machine element being pivoted to the second link. The toggle links are in their aligned and straightened condition when the element is in its extended position and are in their broken condition when the element is in its retracted position. Toggle controlling means are provided for straightening and breaking the toggle means. The first machine part advantageously comprises a first reciprocable ram and a stripper plate, the first leading end portion comprising the strip plate and portions of the first ram. The first toggle link is pivoted to the first ram.

In the preferred embodiment, the machine element is a tool which performs an operation on the workpiece during movement of the machine parts from their open positions to their closed positions. The toggle controlling means preferably comprises toggle breaking means and toggle straightening means, the toggle being in its straightened position during a portion of the cycle during which the machine parts move relatively towards each other and the breaking means is engageable with the knee joint during movement of the machine parts towards each other thereby to shift the toggle means to its broken condition. In the preferred embodiment, the toggle means has a cam follower on the knee joint, the toggle breaking means comprising camming means in the first machine part which engages the can follower thereby to break toggle means. The toggle straightening means comprises resilient means in the first machine part which resilient biases the toggle means to its straightening position.

THE DRAWING FIGURES

FIG. 1 is a top plan view of a machine module.

FIG. 2 is a sectional side view looking in the direction of the arrows 2-2 of FIG. 1 showing the first and second ram assemblies of the tooling assembly, this view showing the positions of the parts when the ram assemblies are in their open or spaced apart positions; FIG. 2 and FIGS. 3-5 are taken along an irregular vertical section line in order to show features which would not be shown if the section line were straight.

THE DISCLOSED EMBODIMENT

Figure 1:
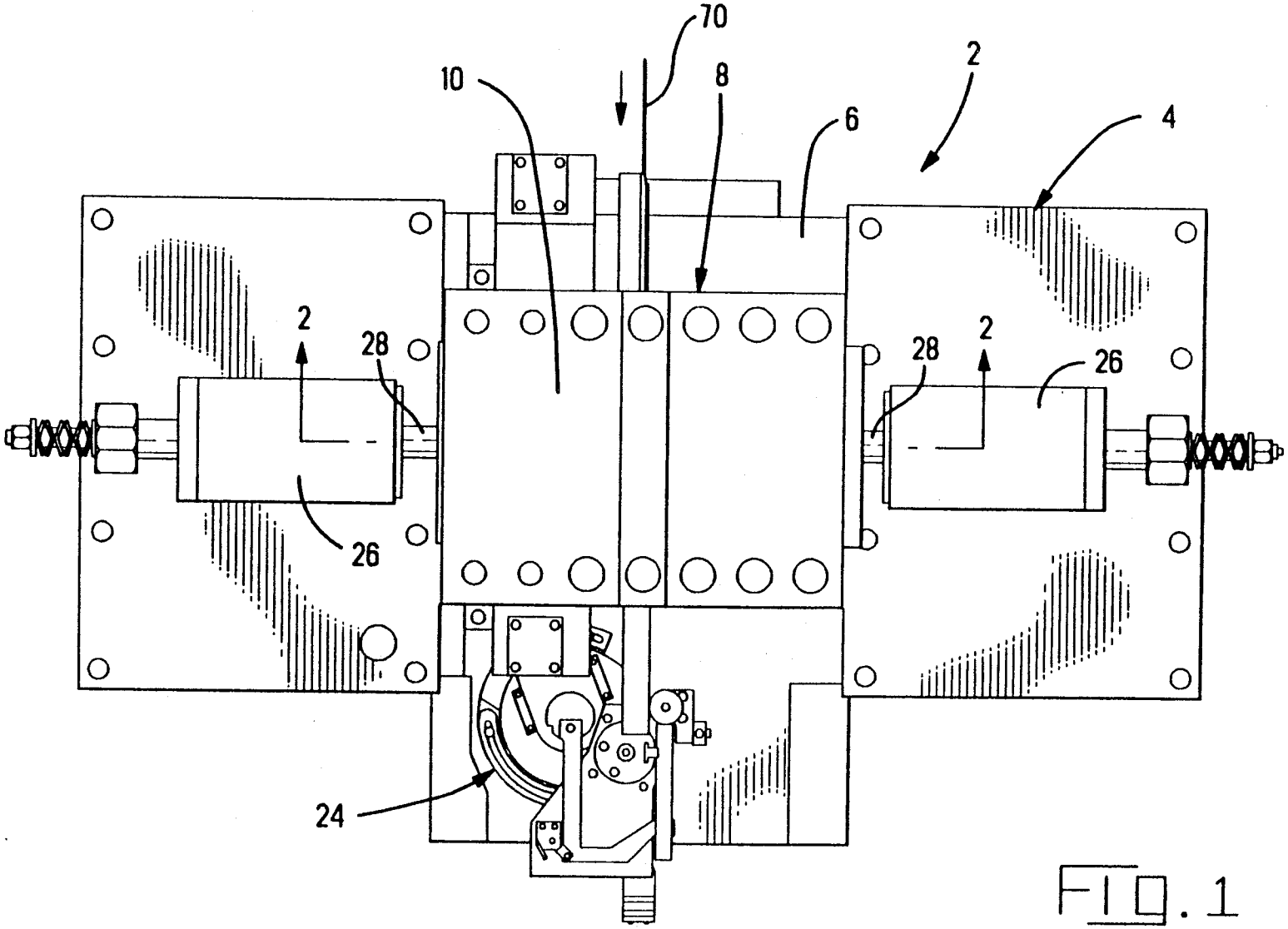

FIG. 1 shows a machine module 2 of the type described in U.S. Pat. Nos. 4,497,196 and 4,819,476. The present invention is concerned with the tooling contained in the module and the module will, therefore, be described only briefly and to the extent necessary for an understanding of the invention.

Figure 2:
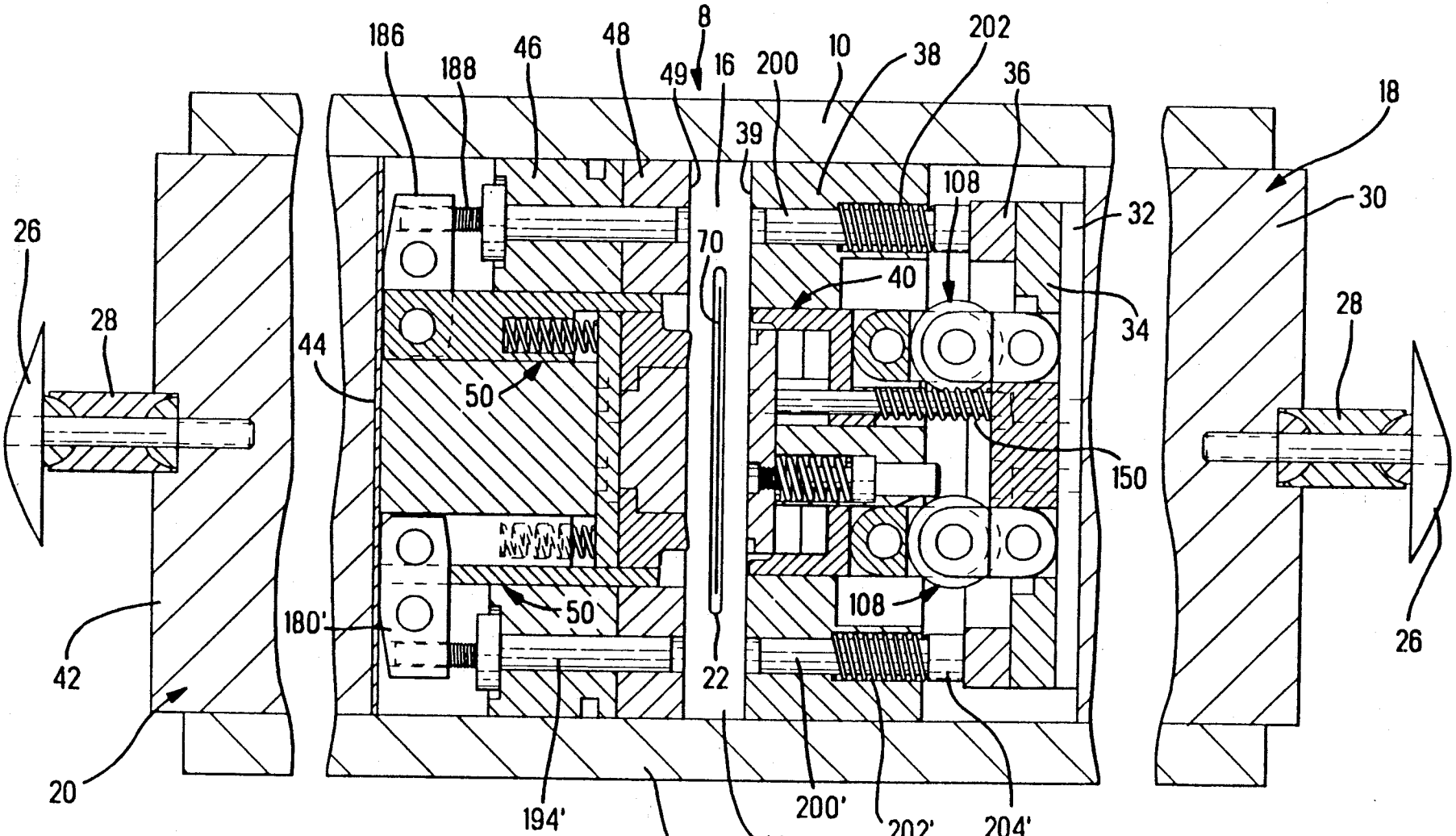

The module 2 comprises a module housing 4 having an upper surface 6 on which a ram housing 8 is supported. The ram housing comprises upper and lower ram housing plates 10, 12 and side plates 14, one of which is shown in FIG. 2. The upper and lower housing plates and the side plates 14 define a rectangular passageway 16 in which there are first and second ram assemblies 18, 20. The side plates have aligned slots 22 through which strip material 70 is fed by a strip feeding mechanism 24 of the type described in U.S. Pat. No. 4,887,452. The ram assemblies 18, 20 are reciprocated towards and away from each other between open and closed positions by oscillating levers, the upper ends of which are shown at 26. These levers are coupled to the ram assemblies by couplings 28 as described in U.S. Pat. No. 4,819,476.

Figure 3:
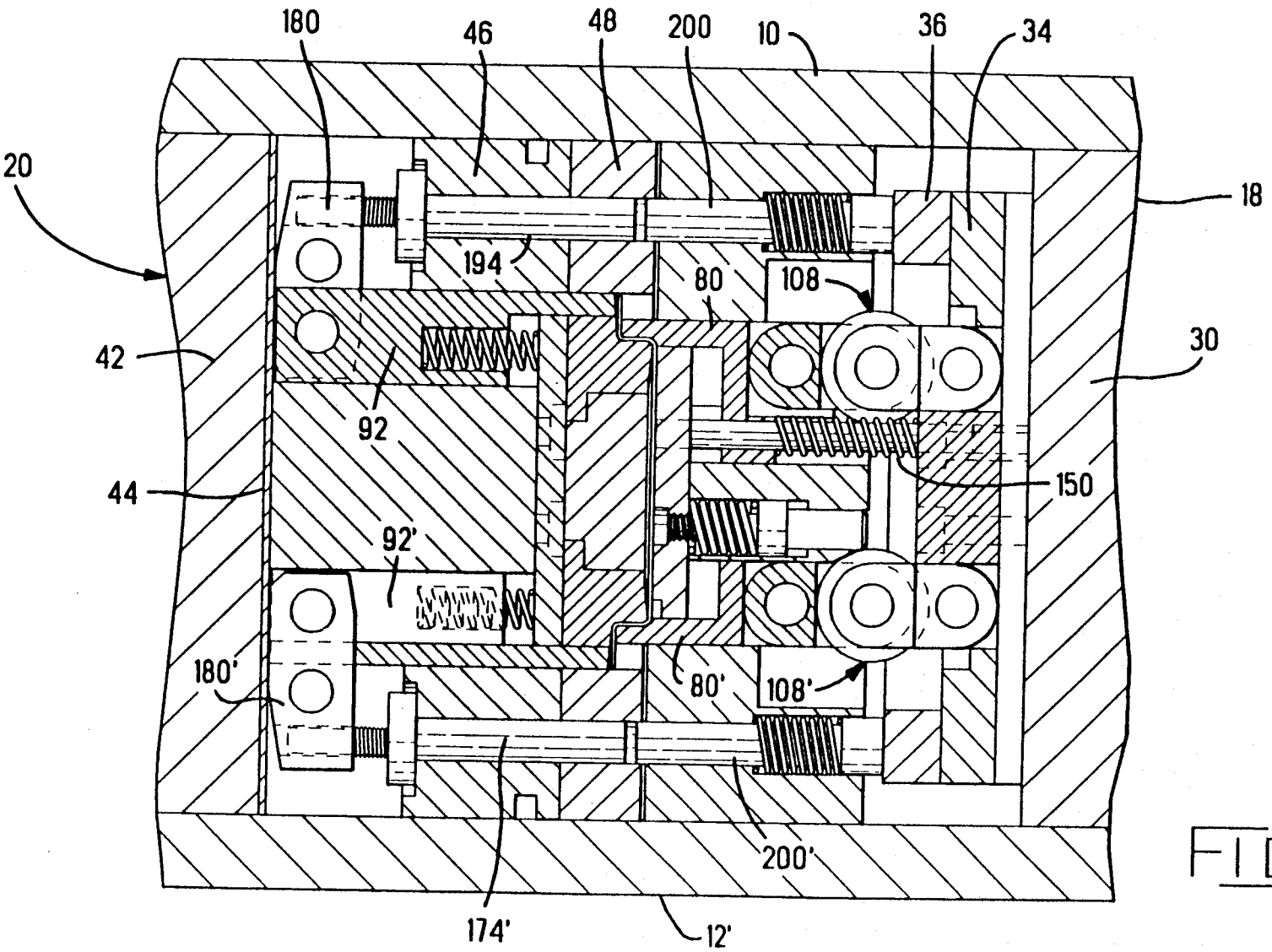
FIG. 3 is a view on an enlarged scale showing the positions of the parts at an intermediate stage of the cycle after the ram assemblies have moved partially towards each other.

The first ram assembly 18 comprises a ram block 30, a spacer plate or backup plate 32, a tool holder 34, an additional tool holder 36, and a stripper plate 38. The backup plate 32, and the tool holders 34, 36 are secured to the face of the ram block 30. The stripper plate 38 is, when the parts are in the positions of FIG. 2, spaced from the tool holder plate 36 and are resiliently biased to the position shown in FIG. 2 by a biasing rod described in U.S. Pat. No. 4,819,476. During movement of the first ram assembly leftwardly to its closed position, FIG. 4, the stripper plate 38 is moved relatively rightwardly as viewed in FIGS. 2-4 so that it is adjacent to the surface of the tool holder plate 36. The strip 70 is clamped between the opposed surfaces 39, 49 of the ram assemblies when they are in their closed positions.

The second ram assembly 20 comprises a ram block 42, a backup or spacer plate 44, and tool holder plates 46, 48. The backup plate, and the tool holder plates are secured to the face of the ram block 42. The tool holder plate 48 has a facial surface 49 which is opposed to the facial surface 39 of the stripper plate 38.

Figure 9:
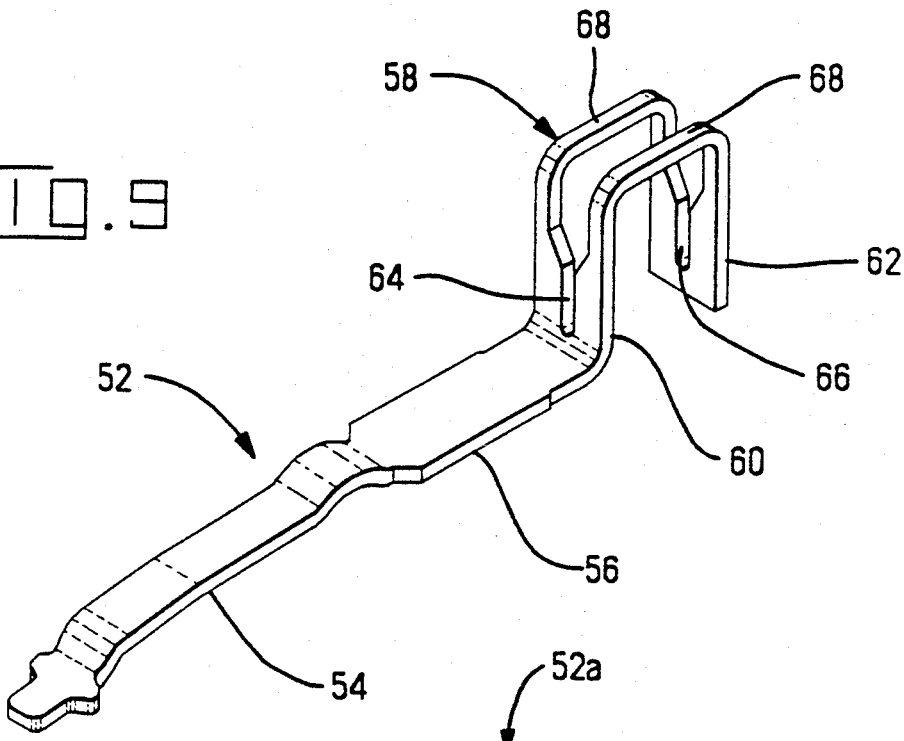
FIG. 9 is a perspective view of a contact terminal produced by the tooling assemblies shown in FIGS. 1-7.
Figure 10:
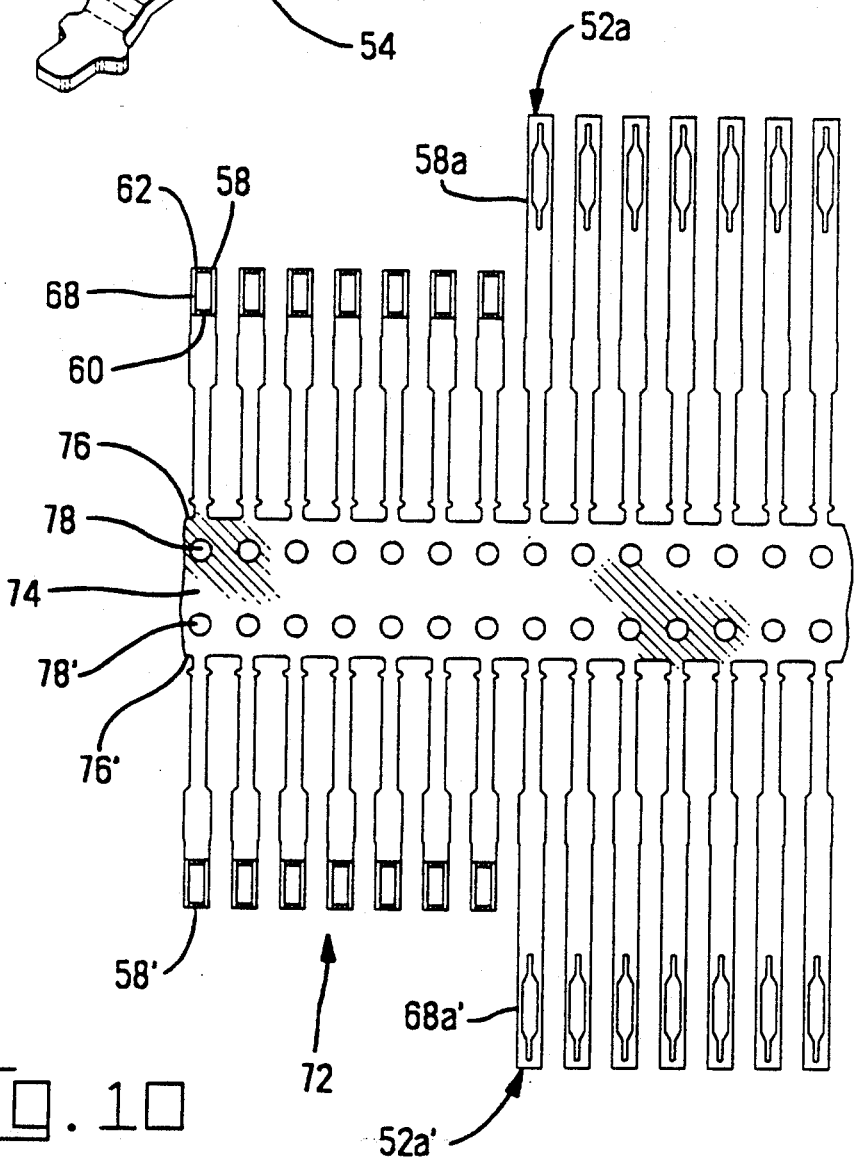
FIG. 10 is a plan view of a portion of blanked strip which is formed by the tooling assembly shown in FIGS. 1-7.

The first ram assembly has a first forming tooling assembly 40 therein and the second ram assembly has a second forming tooling assembly 50 therein. The tooling assemblies 40, 50 perform a U-ing operation on flat blanks 52*a* shown in FIG. 10 which, after the U-ing operation, are further formed to produce contact terminals 52 as shown in FIG. 9. Each terminal comprises a forward contact portion 54, an intermediate relatively flat portion 56, and a U-shaped wire contacting portion 58. The wire contacting portion comprises two spaced apart plate sections 60, 62 which are connected by parallel strap members 68. The plate sections 60, 62 have aligned slots 64, 66 which receive an insulated wire so that the opposed edges of the slot establish contact with the conducting core of the wire.

Contact terminals 52 are manufactured by performing a series of stamping and forming operations on the strip material 70 which is fed through two or more modules of the type shown in FIG. 1. In a first module, the strip material 70 is blanked; that is, the flat blanks 52*a* for the finished terminals are produced. The present invention is concerned only with the U-ing operation in which the portions 58*a* are U-ed to produce the wire receiving portions 58 of the terminals. The progression 72 as received in the module 2 and comprises a central carrier strip 74 having side edges 76, 76'. Spaced apart pilot holes 78, 78' are provided for feeding the strip material through the module. The progression 72 has flat blanks 52*a* extending from both of the side edges 76, 76' and the tooling assemblies simultaneously U blanks on each side of the strip. The die assembly described herein is thus referred to as a "two-out" die assembly. It is, in addition, a multiple feed die assembly which is to say that four or more flat blanks are fed and formed during each operating cycle of the machine.

Figure 5:
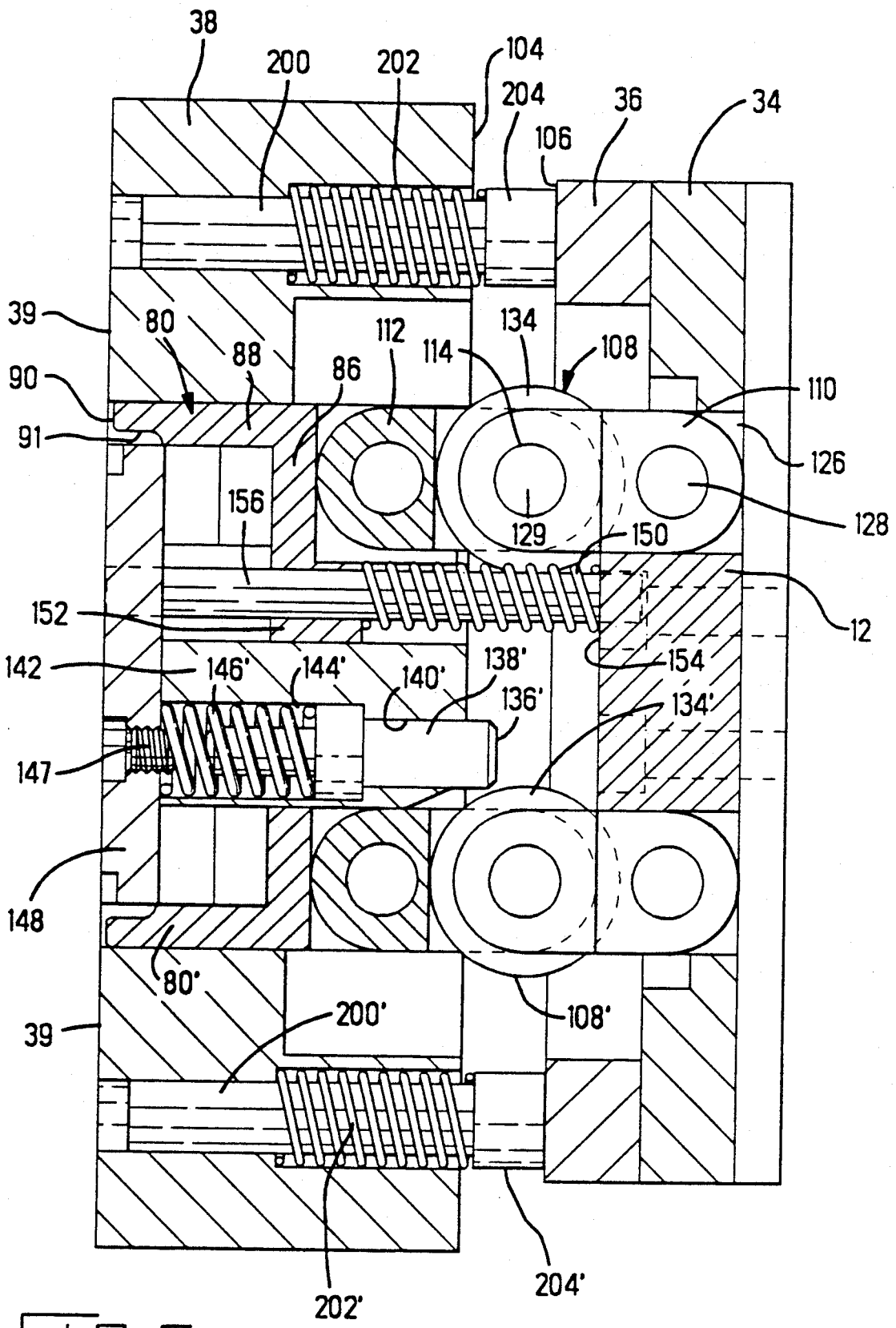
FIG. 5 is a view on an enlarged scale showing the leading end portion of the first ram assembly.

The U-ing operation is carried out by first forming tools 80, 80' which are on the first ram assembly 18, second forming tools 82, 82', and fixed anvils 84, 84'. The second forming tools 82, 82' and the fixed anvils are on the second ram assembly 20. It will be apparent from FIGS. 5 and 6 that the tooling in the upper portion of the ram assemblies is a mirror image of the tooling assemblies in the lower portion. The corresponding tooling members and parts thereof are therefore identified by the same reference numerals differentiated by prime marks.

Figure 7A:
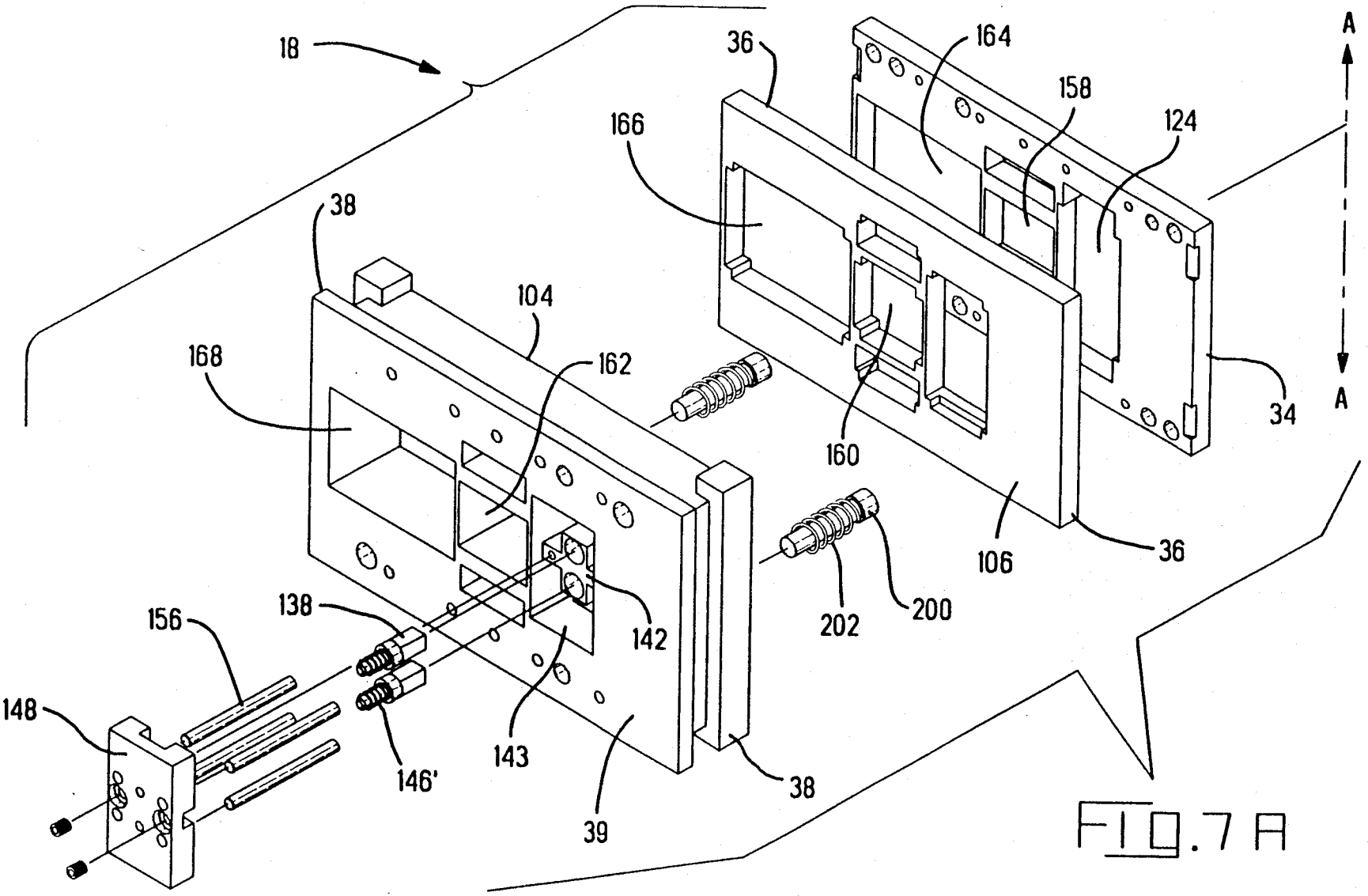
FIGS. 7A and 7B show the first tooling assembly and portions of the ram assembly with the parts in exploded positions relative to each other, these views being intended to be placed beside each other along the lines A-A to show all of the parts of the assembly.
Figure 7B:
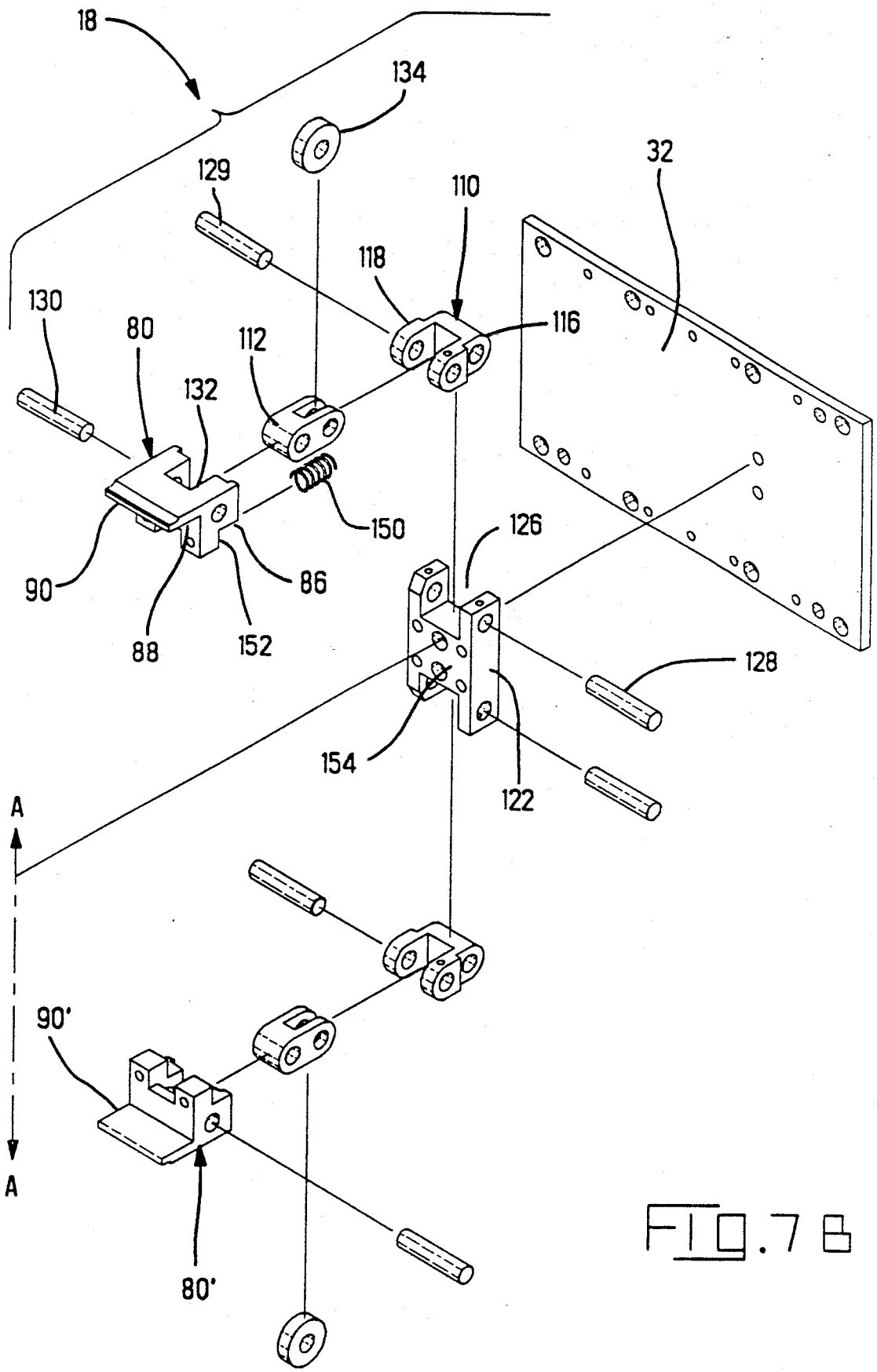

As explained in the description of the drawing figures, FIGS. 2-5 are taken along an irregular vertical section line in order to show features which would not be shown if the section line were straight. For example, FIGS. 2-5 show in the lower portion of the first ram assembly 18 the camming pin 138' which is described below and which is associated with toggle mechanism 108' but do not show camming pin 138 which is associated with the upper toggle 108. These figures show the toggle straightening spring 150 for the upper toggle 108 but do not show the corresponding spring 150' for the lower toggle 108'. FIGS. 7A and 7B show all of the elements in the forward portion of the first ram assembly and can be referred to along with FIGS. 2-5.

In the interest of simplification, only the tooling members and tooling parts in the upper portions of the ram assemblies will be specifically referred to and only unprimed numerals will be used in the description below.

The first forming tool 80 comprises a base portion 86 having a flange 88 extending therefrom which constitutes the tooling member. This flange or arm 88 has a free end 90 having a recess 91 on its lower surface. At the beginning of the operating cycle and when the parts are in the positions of FIG. 2, the free end is located at the facial surface 39 of the stripper block 38 and moves outwardly from the surface as will be described below, when the U-ing operation is carried out.

Figure 4:
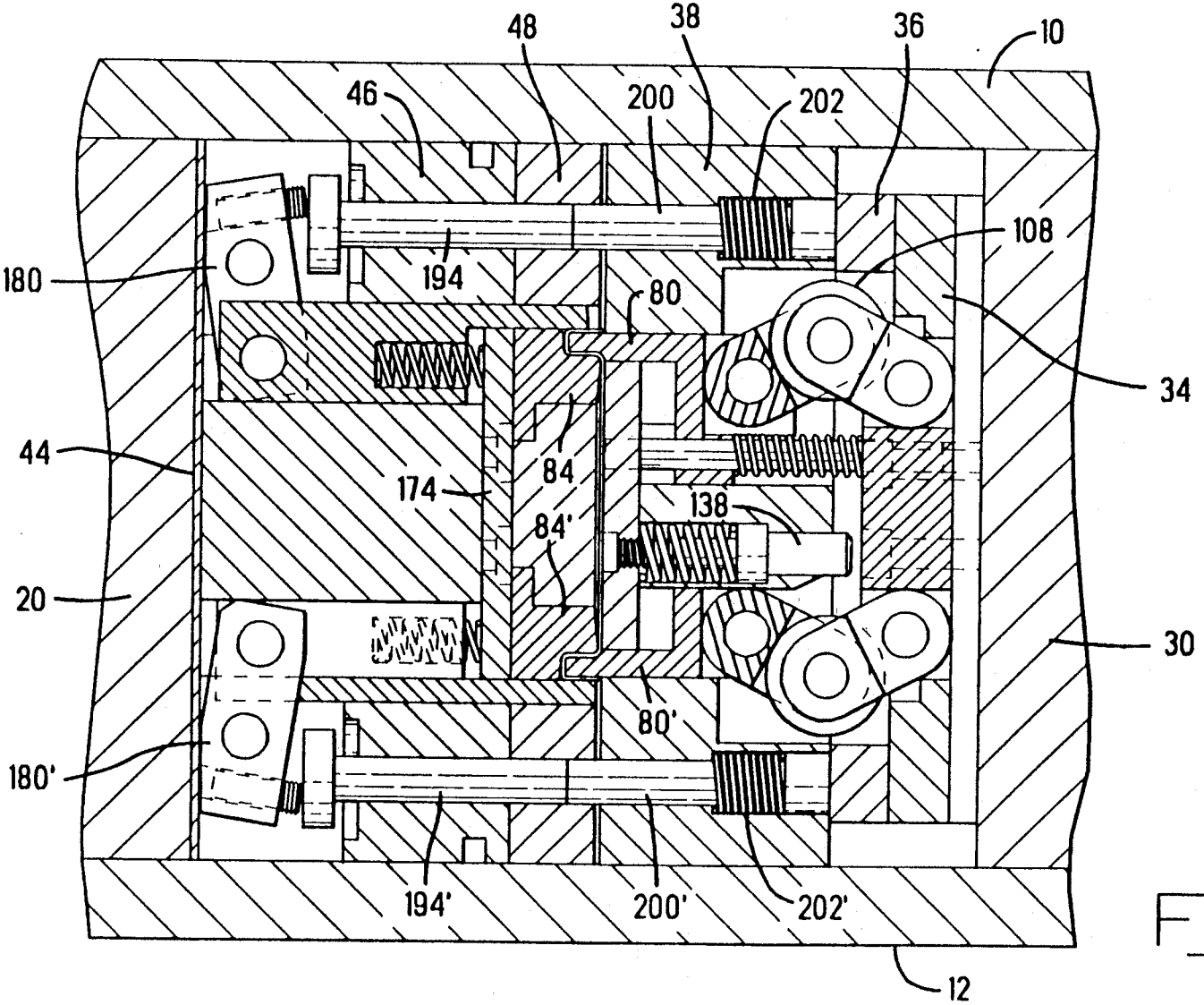
FIG. 4 is a view similar to FIG. 3 showing the positions of the parts when the ram assemblies are in their closed positions and substantially against each other.

The second forming tool 82 has a base portion 92 which is slidably contained in the tooling block 46 and which has a forwardly extending arm 94 having a free end 96. This arm constitutes the second forming member. The anvil 84 has a surface 98 which is substantially located at the surface 49 of the tooling plate 48 but which is inclined slightly inwardly and downwardly so that the blank will be somewhat overformed or overbent in order to allow for spring back. A recess 100 is provided in the anvil 84 and has an inner end 102 and a side surface 101. The arm 94 moves past the recess, as shown in FIG. 4 when the ram assemblies move to their closed positions.

The toggle mechanism 108 which controls the movement of the first forming tool comprises first and second toggle links 110, 112 which are pivoted to each other at a knee joint 114. The first toggle link 110 is generally U-shaped as shown in FIG. 7 having a bight or body portion 116 and spaced apart arms 118 extending from the body portion. The pivot pin 129 for the knee joint 114 extends between these arms and through the second toggle link 112. The inner fixed end of the first toggle link is pivoted on a pin 128 in an H-shaped adapter plate or mounting plate 122. This plate 122 is in turn received in an opening 124 in the tooling plate 34. The first toggle link 110 is pivoted in a recess 126 at the upper end of plate 122 by means of the pivot pin 128.

The second link is pivoted on the pin 130 which extends through a recess 132 in the base portion 86 of the forming tool 80. The toggle mechanism is shifted from its straightened condition, FIG. 2, to its broken condition, FIG. 4, by means of a cam follower 134 which is mounted on the pivot pin 128. This cam follower is engaged by the chamfered end 136 of a camming pin 138 which is received in an opening 140 in a plate 142 which in turn is fixed in an opening 143 in the stripper plate 38. The opening 140 is counter-bored as shown at 144 and a reduced end portion of the pin 138 extends into the counter-bore and beyond an intermediate collar on the pin. A spring 146 surrounds the reduced end portion of the pin and bears against a face plate 148 which is secured to the plate 142 and which has a surface which is coplanar with the surface 39 of the stripper plate. A set screw 147 in plate 148 is in alignment with pin 138 and provides a fixed stop for the pin.

After the U-ing operation has been carried out and the ram assemblies moved back to their initial positions, it is necessary to shift the toggle mechanisms from their broken conditions to their straightened conditions. Shifting of each toggle mechanism is accomplished by means of a return springs 150 which are interposed between a depending lip 152 on the forming tool 80 and the leftwardly facing surface 154 as viewed in the drawing, of the H-shaped plate 122. The spring surround associated rods 156 which are mounted in the face plate 148 and which extends through the depending lip 156 of the forming tool 80. These rods 156 extend beyond the surface 154 of the plate 122 and into a recess in the tooling plate 34.

The U-ing operation is only one of three operations carried out by the module shown in FIGS. 7A and 7B. Additional openings as shown at 158, 160, 162, 164, 166, and 168 are provided in the tooling plates 34, 36 and in the stripper plate 38 for these other tooling members. These other tooling members are not shown or described for the reason that they are not part of the present invention. It might be mentioned, however, that the tooling which is received in the openings 158, 160 and 162 perform a qualifying operation on the U-shaped portions of the terminals and the tooling mounted in the openings 164, 166, and 168 performs forming operations on the contact end portions of the terminals.

Figure 6:
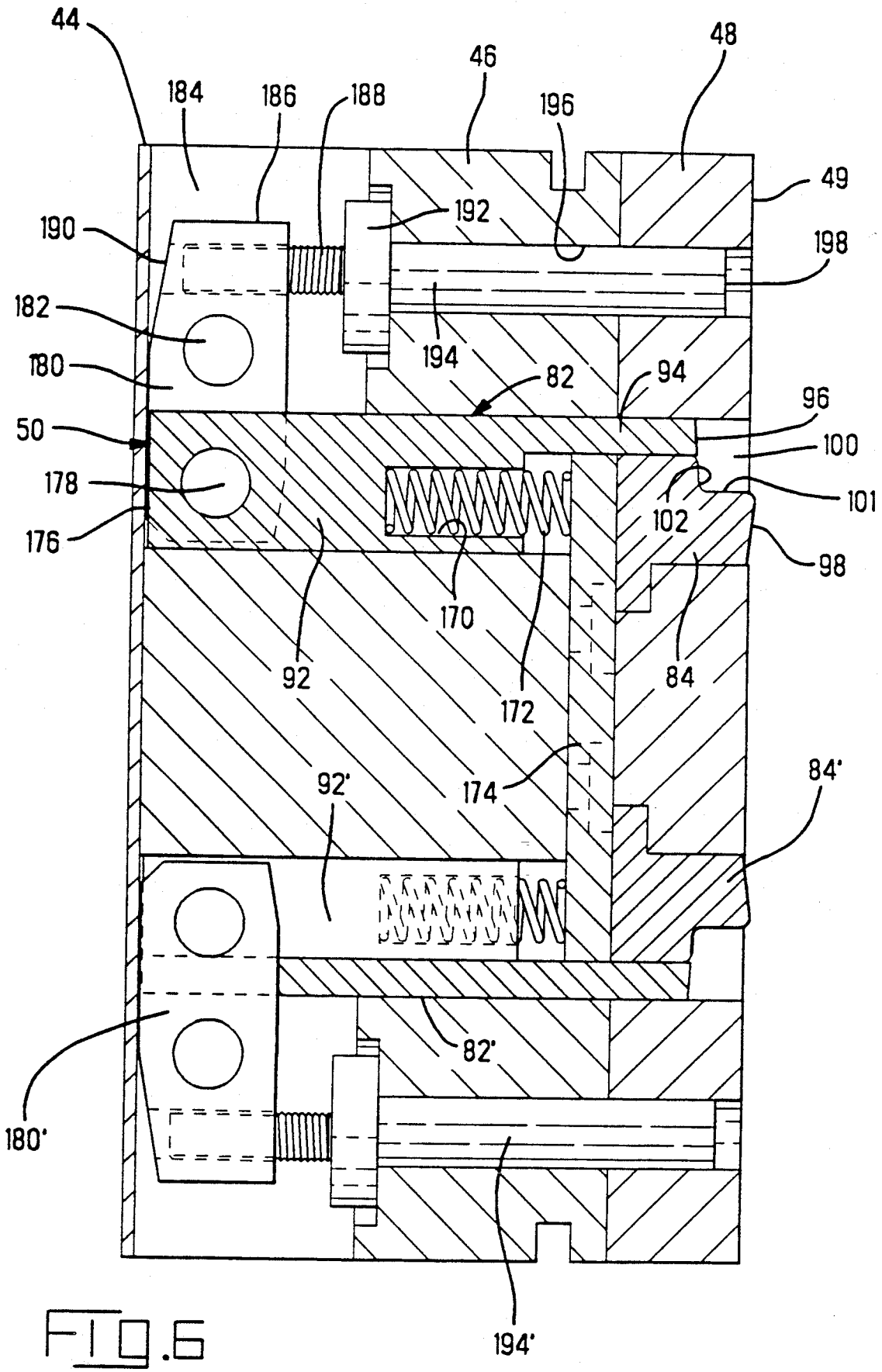
FIG. 6 is an enlarged view showing the leading end portion of the second ram assembly.

As shown in FIG. 6, the base or shank portion 92 of the second tooling member 50 has an opening 170 extending leftwardly therein from a location beneath the arm 94. A spring 172 is contained in this opening and is between a spacer plate 174 in the inner end of the opening thereby to bias the tooling member 50 leftwardly as viewed in FIG. 6. The left-hand end 176 of the shank or base portion 92 is pivotally connected as at 178 to an upwardly extending lever 180 which is pivoted intermediate its ends at 182. The lever and the end portion of the shank 92 are received in a recess 184 in the tool holder plate 46. The upper end 186 of lever 180 has a set screw 188 therein which bears against the enlarged head 192 of a rod 194 which is slidably received in an opening 196 which extends through the tooling plates 46, 48 and to the facial surface 49. When the parts are in their positions at the beginning of the operating cycle, the end 198 of the rod 194 is substantially flush with the facial surface 49. During the operating cycle, the rod 194 is moved leftwardly thereby causing the lever 180 to swing in a counter-clockwise direction and drive the tooling member 50 rightwardly as viewed in FIG. 6. Such rightward movement of the projecting portion 94 bends the plate section 62 of the blank so that at the end of the stroke of the ram assemblies toward each other, the now- formed contact portion 58 of the terminal 52 is confined between the side surface of the tooling member 94 and the side surface 101 of anvil 84 with the end portion 90 of the first tooling member positioned in the U-shaped section and between the plate members 60,62.

The rod 194 is moved leftwardly during the final portion of the stroke of the ram assemblies toward each other by a rod 200 which is slidably mounted in the stripper plate 38 and which has an enlarged end 204 which bears against the surface 106 of the tool holder plate 36. A spring 202 surrounds the rod 200 and is interposed between the enlarged end portion 204 and the inner end of a counter-bore as shown in FIGS. 2 and 6.

An advantageous feature of the invention is that the use of heavy duty springs, such as would be required for the forming tool 80 if it were controlled by a spring, is avoided and the forming tool is controlled by a toggle mechanism. Springs are used in the disclosed embodiment as shown at 202, 146, 150, and 172 but these are light duty return springs. They are long-lived and do not significantly increase the capacity of the press required for the punch and die assembly.

Figure 8:
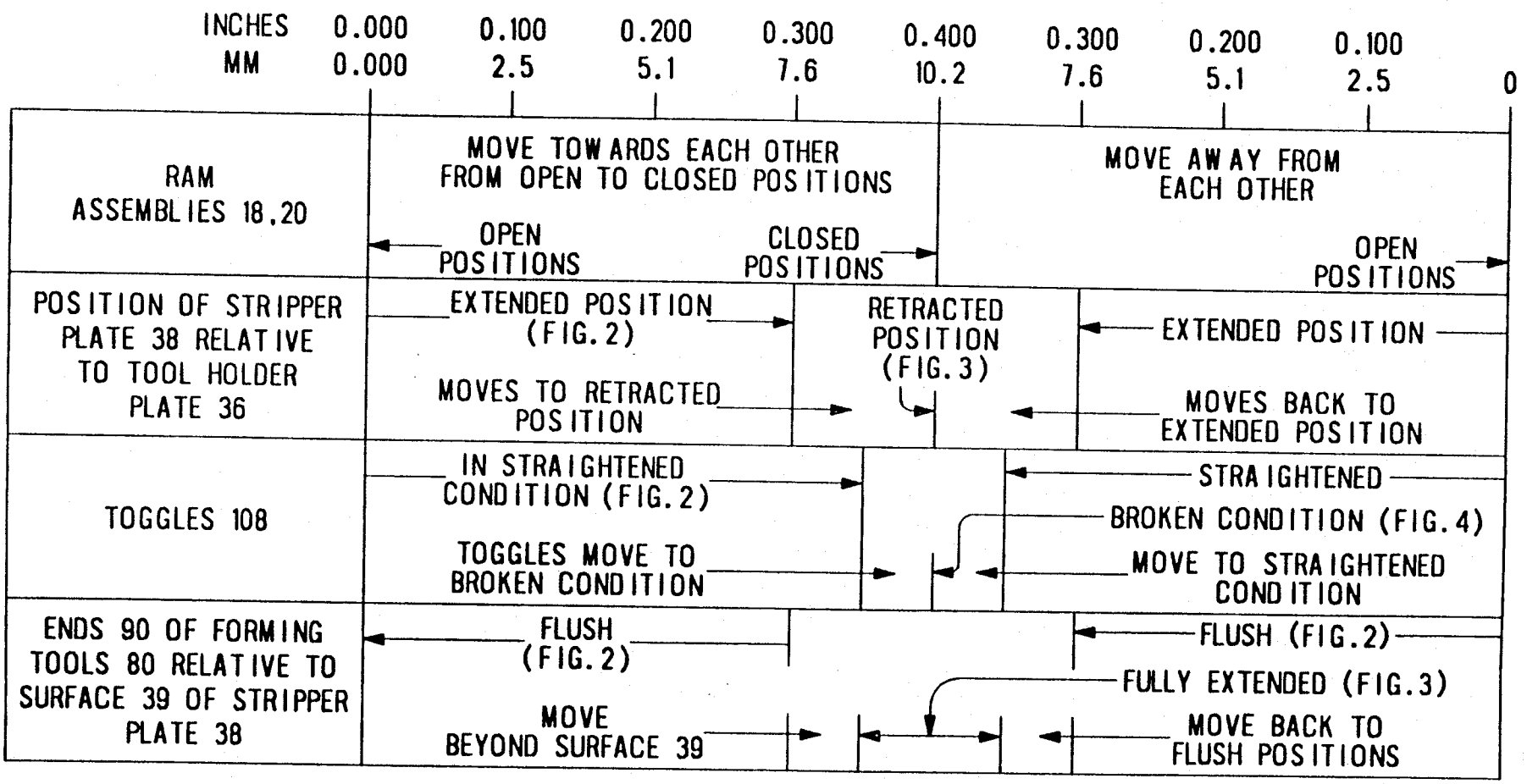
FIG. 8 is a timing diagram which illustrates the movement of the parts during an operating cycle.

FIG. 8 shows the positions of the principle parts of the tooling assemblies during a complete operating cycle in which the ram assemblies move from their open positions, FIG. 2, to their closed positions shown in FIG. 4 and back to their open positions. It will be apparent from FIG. 8 that the actual forming operations take place only during the final portion of the stroke of the ram assemblies to their closed positions. The travel of the rams is relatively short as compared with conventional stamping and forming dies and in FIG. 8, the total travel of each ram being 0.400 inches (10.2 mm) in the disclosed embodiment.

The operating cycle is described briefly in the following paragraph.

At the beginning of the cycle, the ram assemblies will be in the positions of FIG. 2 and the strip material 70 will have been fed so that a plurality of flat blanks 52*a*, 52*a*′ will be positioned between the tooling assemblies 40, 50, 40′, 50′ in the ram assemblies 18, 20. During an initial portion of the cycle, the stripper plate 38 is in its extended position of FIG. 2. As the end of the stroke is approached, the facial surface 39 of the stripper plate 38 moves against the surface 49 of the tooling plate 48 on the second ram assembly 20 and the strip material is deflected a short distance rightwardly as viewed in the drawing. The tooling plates 34, 36 move relatively towards the rearwardly facing surface 104 of the stripper plate until the surfaces 104, 106 are against each other. The ends 90, 90′ of the forming tools 80, 80′ begin to move beyond the facial surface 39 of the stripper plate and form the wire receiving portions 58, 58′ of the blanks. During a short portion of the cycle after the stripper plates has moved against the surface of the tooling plate of the second ram assembly, the toggle mechanisms remain in their straightened condition; however, toward the end of the cycle, the toggles are shifted to their broken conditions by the camming pins 138, 138′. During the final portion of the cycle, the second tooling members 80, 80′ move from the positions of FIG. 4 to the positions of FIG. 5 thereby to complete the forming operation. When the ram assemblies move from their closed positions to their open positions, the toggle mechanisms are straightened by the compression springs 150 and the parts return to their positions as shown in FIG. 2.

The practice of the invention does not require the stripper plate 38; the stripper plate is required in the disclosed embodiment to remove the formed terminal strip from the forming tools on the first ram assembly. Under some circumstances, the invention might be used in a die assembly which does not require a stripper plate. Also, it should be noted that the timing diagram, FIG. 8, is valid for a particular embodiment of the invention. Alternative embodiments might be designed such that the operations described take place at times in the cycle other than those indicated in the diagram.

Significant advantages are achieved in the practice of the invention as a result of the fact that heavy duty springs are eliminated and a toggle mechanism is employed to control the movement of the first tooling members in the ram assemblies. The forming tools 80, 80′ are rigidly supported by the toggle mechanisms while they are forming the blanks.

I claim:

1. A stamping and forming machine having first and second machine parts which move relatively towards and away from each other between open and closed positions during each operating cycle of the machine, the first and second machine parts having opposed first and second leading end portions which are adjacent to each other when the parts are in their closed positions and which are spaced apart when the parts are in their open positions, the first part having a machine element therein which extends normally of the first leading end portion and which contacts a workpiece, which is between the leading end portions, during movement of the parts from their open positions to their closed positions, the element being in an extended position during one portion of the operating cycle and being in a retracted position during another portion of the operating cycle, and element moving means for moving the element between its extended and retracted positions, the machine being characterized in that:

the element moving means comprises toggle means in the first machine part, the toggle means comprises first and second toggle links which are pivotally connected at a knee joint, the first link being pivoted to the first machine part, the machine element being pivoted to the second link, the toggle links being in their aligned and straightened condition when the element is in its extended position and being in their broken condition when the element is in its retracted position, and toggle controlling means are provided for straightening and breaking the toggle means.

2. A machine as set forth in claim 1 characterized in that the first machine part comprises a first reciprocable ram and a stripper plate, the first leading end portion comprises the stripper plate and portions of the first ram, the first toggle link being pivoted to the first ram.

3. A machine as set forth in claim 1 characterized in that the machine element is a tool which performs an operation on the workpiece during movement of the machine parts from their open positions to their closed positions.

4. A machine as set forth in claim 3 characterized in that the tool is a forming tool.

5. A machine as set forth in claim 1 characterized in that the toggle controlling means comprises toggle breaking means and toggle straightening means, the toggle being in its straightened condition during a portion of the cycle during which the machine parts move relatively towards each other, the toggle breaking means being engageable with the knee joint during movement of the machine parts towards each other thereby to shift the toggle means to its broken condition.

6. A machine as set forth in claim 5 characterized in that the toggle means has a cam follower on the knee joint, the toggle breaking means comprises camming means in the first machine part which engages the cam follower thereby to break the toggle means.

7. A machine as set forth in claim 5 characterized in that the toggle straightening means comprises resilient means in the first machine part which resiliently biases the toggle means to its straightened condition.

8. A machine as set forth in claim 5 characterized in that the toggle straightening means comprises resilient means in the first machine part which resiliently biases the toggle means to its straightened condition, and the toggle breaking means comprises a cam follower on the knee joint and camming means in the first machine part, the camming means being engageable with the cam follower thereby to break the toggle means.

9. A machine as set forth in claim 1 characterized in that the first and second machine parts comprise first and second reciprocable rams which move towards and away from each other between the open and closed positions.

10. A machine as set forth in claim 2 characterized in that the machine element is slidably contained in the stripper plate, the extended and retracted positions of the machine element being extended and retracted positions with respect to the first ram.

11. A machine as set forth in claim 10 characterized in that the stripper plate has a facial surface which is opposed to the second machine part and a rear surface which is opposed to the first ram, the rear surface being spaced from the first ram when the machine parts are in their open positions and being movable relatively towards the first ram during movement of the machine parts to their closed positions.

12. A machine as set forth in claim 11 characterized in that the toggle controlling means comprises toggle breaking means and toggle straightening means, the toggle being in its straightened condition during a portion of the cycle during which the machine parts move relatively towards each other, the toggle breaking means being engageable with the knee joint during movement of the machine parts towards each other thereby to shift the toggle means to its broken condition.

13. A machine as set forth in claim 11 characterized in that the toggle is in its straightened condition during an initial portion of the cycle during which the machine parts move relatively towards each other and during which the stripper plate moves relatively towards the first ram, and the toggle means is shifted to its broken condition during an intermediate portion of the cycle which comes after the initial portion, the toggle controlling means comprises toggle breaking means and toggle straightening means which are contained in the first machine part, the toggle breaking means comprises a cam follower on the knee joint of the toggle means and a cam which is contained in the stripper plate and which engages the cam follower at the end of the initial portion of the cycle thereby to shift the toggle means to its broken condition, the toggle straightening means comprises resilient means which biases the toggle means to its straightened condition.

14. A machine as set forth in claim 13 characterized in that the machine element has an integral mounting portion which is pivoted to the second toggle link, the mounting portion has a shoulder which is opposed to the first ram, the toggle straightening means comprises a spring which is interposed between the first ram and the shoulder whereby, the spring is compressed when the cam engages the cam follower and the toggle means is shifted to its broken condition, and during movement of the machine parts from their closed positions to their open positions, the compressed spring restores the toggle means to its straightened condition.

15. A machine as set forth in claim 14 characterized in that the second machine part comprises a second ram which is reciprocable towards and away from the first ram, the machine element is a first forming tool, the second ram has a second forming tool thereon, and the workpiece is an initially flat blank which is formed into a U-shape by the first and second forming tools.

16. A stamping and forming machine comprising first and second ram assemblies which move towards and away from each other during an operating cycle between open and closed positions, the ram assemblies being spaced apart when in their open positions and being adjacent to each other when in their closed positions, first and second forming tools on the first and second ram assemblies which engage w workpiece which is between the ram assemblies and which perform an operation on the workpiece as the ram assemblies move to their closed positions, the first tool being movable between an extended position and a retracted position relative to the first ram assembly, the first tool being in its extended position during one portion of each cycle and being in its retracted position during another portion of the cycle, and first tool moving means are provided for moving the first tool between its retracted and extended positions, the machine being characterized in that:

the moving means comprises toggle means in the first ram assembly, the toggle means comprises first and second toggle links which are pivotally connected at a knee joint, the first link being pivoted to the first ram assembly, the tool being pivoted to the second link, the toggle links being in their aligned and straightened condition when the tool is in its extended position and being in their broken condition when the tool is in its retracted position, and toggle controlling means are provided for straightening and breaking the toggle means.

17. A machine as set forth in claim 16 characterized in that the first ram assembly comprises a first ram block and a stripper plate, the stripper plate being in front of, and normally spaced from, the first ram block, the stripper plate being movable relatively towards the first ram block during movement of the ram assemblies to their closed positions, the first toggle link being pivoted to the first ram block, and the first tool being slidably contained in the stripper plate.

18. A machine as set forth in claim 17 characterized in that the toggle controlling means comprises toggle breaking means and toggle straightening means, the toggle being in its straightened condition during a portion of the cycle during which the ram assemblies move relatively towards each other, the toggle breaking means being engageable with the knee joint during movement of the ram assemblies towards each other thereby to shift the toggle means to its broken condition.

19. A machine as set forth in claim 13 characterized in that the toggle straightening means comprises resilient means in the first ram assembly which resiliently biases the toggle means to its straightened condition, and the toggle breaking means comprises a cam follower on the knee joint and camming means in the stripper plate, the camming means being engageable with the cam follower thereby to break the toggle means.

* * * * *